US011758333B1

(12) United States Patent
Huang et al.

(10) Patent No.: US 11,758,333 B1
(45) Date of Patent: Sep. 12, 2023

(54) MULTI-FUNCTIONAL SOUND PRODUCING APPARATUS

(71) Applicant: AAC Microtech (Changzhou) Co., Ltd., Changzhou (CN)

(72) Inventors: Xingzhi Huang, Shenzhen (CN); Yao Wang, Shenzhen (CN); Lubin Mao, Shenzhen (CN); Dong Lu, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/826,192

(22) Filed: May 27, 2022

(30) Foreign Application Priority Data

Mar. 2, 2022 (CN) ..... 202220441737.7

(51) Int. Cl.

| | |
|---|---|
| ***H04R 11/02*** | (2006.01) |
| ***H04R 7/04*** | (2006.01) |
| ***H04R 1/02*** | (2006.01) |
| ***H04R 1/28*** | (2006.01) |

(52) U.S. Cl.
CPC ..... *H04R 11/02* (2013.01); *H04R 1/021* (2013.01); *H04R 1/2811* (2013.01); *H04R 7/04* (2013.01); *H04R 2400/03* (2013.01); *H04R 2400/07* (2013.01); *H04R 2400/11* (2013.01)

(58) Field of Classification Search
CPC ..... H04R 11/02; H04R 1/021; H04R 1/2811; H04R 7/04; H04R 2400/03; H04R 2400/07; H04R 2400/11
See application file for complete search history.

(56) References Cited

U.S. PATENT DOCUMENTS

2020/0153324 A1* 5/2020 Xu ..... H02K 33/02
2022/0209635 A1* 6/2022 Shao ..... H02K 33/02

FOREIGN PATENT DOCUMENTS

CN 113794975 A * 12/2021

* cited by examiner

*Primary Examiner* — Sunita Joshi
(74) *Attorney, Agent, or Firm* — W&G Law Group

(57) ABSTRACT

The present disclosure provides multi-functional sound producing apparatus, including housing defining receiving cavity and sound producing device. The sound producing device includes vibration system and magnetic circuit unit driving vibration system to vibrate along first direction. The magnetic circuit unit includes main magnet assembly and auxiliary magnet. The apparatus further includes motor device which includes elastic member fixedly connected to housing, weight connected to elastic member, magnet component fixed to weight and vibrating along second direction with weight, and driving member fixed to bottom wall to drive magnet component to vibrate. Two groups of magnet component and driving member are provided, each of two opposite sides of main magnet assembly is provided with one group of magnet component and driving member, and second direction is perpendicular to first direction. The present disclosure has advantages of simple assembly, more saved overall space, low costs.

10 Claims, 5 Drawing Sheets

MULTI-FUNCTIONAL SOUND PRODUCING APPARATUS

TECHNICAL FIELD

The present disclosure relates to the technical field of electronic equipment, and in particular, to a multi-functional sound producing apparatus.

BACKGROUND

With the development of electronic technologies, portable consumer electronic equipment is more and more popular, such as mobile phones, hand-held game consoles, navigation apparatuses or hand-held multimedia entertainment devices. Such electronic equipment typically provides system feedback by voice and/or vibration, such as incoming calls from the mobile phones, navigation cues, or vibration feedback from the game consoles.

In the related art, vibration feedback and voice feedback of the electronic equipment are completed by different devices respectively. However, the electronic equipment tends to be short and thin. The more the devices, the less likely the volume of the electronic equipment is reduced.

Therefore, there is a need to provide a new multi-functional sound producing apparatus to solve the above technical problems.

SUMMARY

An objective of the present disclosure is to provide a multi-functional sound producing apparatus with simple assembly, saved overall space, and low costs.

In order to achieve the above objective, the present disclosure provides a multi-functional sound producing apparatus, including a housing defining a receiving cavity and a sound producing device arranged in the receiving cavity, the housing including a bottom wall and a side wall bending and extending from the bottom wall, the sound producing device including a vibration system and a magnetic circuit unit driving the vibration system to vibrate to produce sound along a first direction, the magnetic circuit unit including a main magnet assembly fixed to the bottom wall and an auxiliary magnet spaced from the main magnet assembly to form a magnetic gap, wherein the multi-functional sound producing apparatus further includes a motor device arranged in the receiving cavity, the motor device includes an elastic member fixedly connected to the housing, a weight connected to the elastic member to be suspended in the receiving cavity, a magnet component fixed to the weight and vibrating along a second direction together with the weight, and a driving member fixed to the bottom wall to drive the magnet component to vibrate, two groups of the magnet component and the driving member are provided, two opposite sides of the main magnet assembly are each provided with one group of the magnet component and the driving member, and the second direction is perpendicular to the first direction.

Optionally, the driving member is a coil, the magnet component includes a first magnet, a second magnet, and a third magnet arranged side by side, the first magnet and the third magnet are magnetized along the first direction and have opposite polarity, and the second magnet is magnetized along the second direction.

Optionally, the driving member includes an iron core and a solenoid wound on the iron core, the magnet component includes a magnet, the magnet is magnetized along a third direction, and the third direction is perpendicular to the first direction and perpendicular to the second direction.

Optionally, the magnet is a three-stage magnetized magnet, and the polarity in the middle of the magnet is opposite to the polarity at each of two ends of the magnet.

Optionally, the weight is of a hollow ring-shaped structure, and the weight is provided with a recessfor receiving the magnet component.

Optionally, the multi-functional sound producing apparatus is of a rectangle structure, and the magnet component and the driving member are arranged in a major-axis direction of the multi-functional sound producing apparatus.

Optionally, the vibration system includes a diaphragm, a voice coil driving the diaphragm to vibrate to produce sound, and a voice coil bracket connecting the voice coil and the diaphragm, the voice coil bracket includes a first fixed portion connected to the voice coil, a second fixed portion connected to the diaphragm, and a connecting portion that connects the first fixed portion and the second fixed portion and has step structure, and a plurality of connecting portions are provided and spaced from one another.

Optionally, the multi-functional sound producing apparatus further includes a fixed ring, and the fixed ring has one end fixedly connected to the magnetic circuit unit and the other end fixedly connected to the diaphragm.

Optionally, the diaphragm includes a dome and a suspension fixed to the side of the dome close to the motor device, the side of the suspension close to the magnetic circuit unit is connected to the fixed ring, and the side of the suspension away from the magnetic circuit unit is connected to the side wall of the housing.

Optionally, the side wall of the housing includes a first side wall and a second side wall stacked on each other, the multi-functional sound producing apparatus further includes an air-permeable isolation member sandwiched between the first side wall and the second side wall, and the air-permeable isolation member extends into the receiving cavity.

Compared with the related art, a multi-functional sound producing apparatus according to the present disclosure includes a housing defining a receiving cavity and a sound producing device arranged in the receiving cavity. The housing includes a bottom wall and a side wall bending and extending from the bottom wall. The sound producing device includes a vibration system and a magnetic circuit unit driving the vibration system to vibrate to produce sound along a first direction, the magnetic circuit unit including a main magnet assembly fixed to the bottom wall and an auxiliary magnet spaced from the main magnet assembly to form a magnetic gap. The multi-functional sound producing apparatus further includes a motor device arranged in the receiving cavity. The motor device includes an elastic member fixedly connected to the housing, a weight connected to the elastic member to be suspended in the receiving cavity, a magnet component fixed to the weight and vibrating along a second direction together with the weight, and a driving member fixed to the bottom wall to drive the magnet component to vibrate. Two groups of the magnet component and the driving member are provided, two opposite sides of the main magnet assembly are each provided with one group of the magnet component and the driving member, and the second direction is perpendicular to the first direction. According to the present disclosure, the same device can realize the performance of a speaker and a motor at the same time, the assembly of the device is simple through reasonable position design, more overall space is saved, and the cost is lower.

BRIEF DESCRIPTION OF DRAWINGS

In order to more clearly illustrate the technical solutions in embodiments of the present disclosure, the accompanying drawings used in the description of the embodiments will be briefly introduced below. It is apparent that, the accompanying drawings in the following description are only some embodiments of the present disclosure, and other drawings can be obtained by those of ordinary skill in the art from the provided drawings without creative efforts.

DESCRIPTION OF EMBODIMENTS

Figure 1:
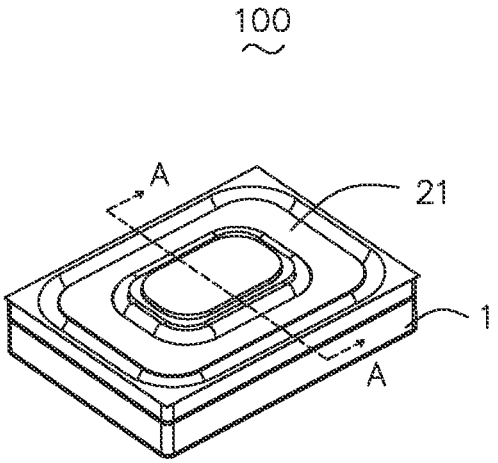
FIG. 1 is diagram of a three-dimensional structure of a multi-functional sound producing apparatus according to a first embodiment of the present disclosure.
Figure 2:
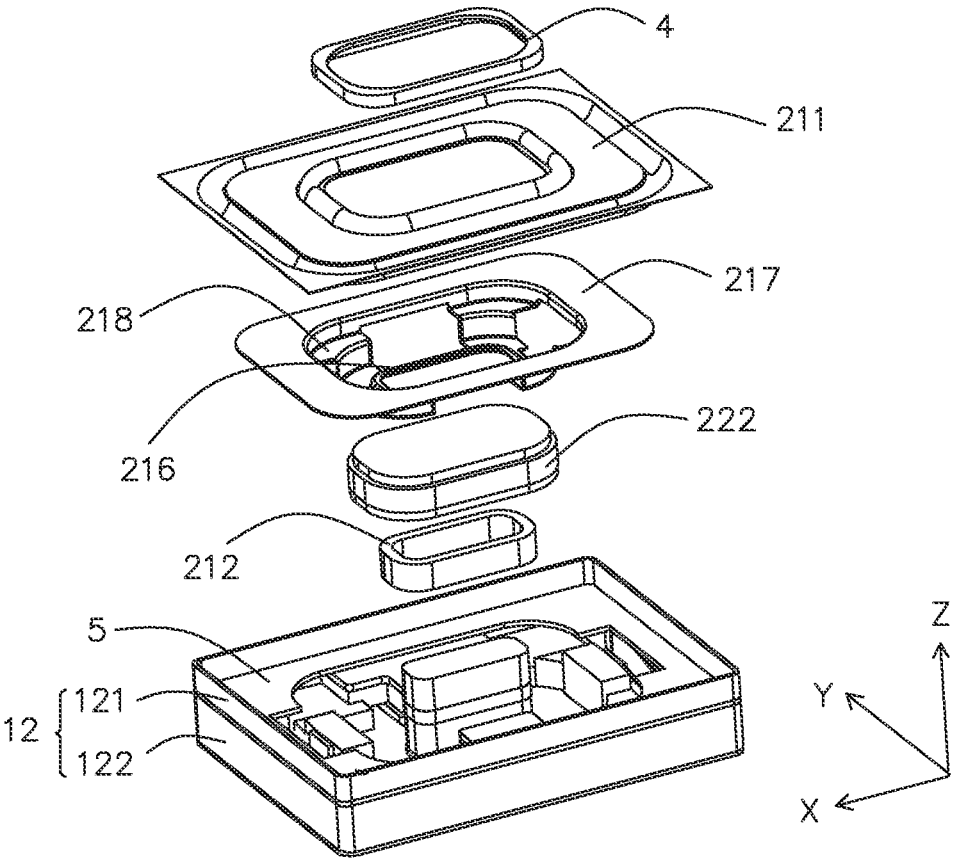
FIG. 2 is a partial exploded view of the multi-functional sound producing apparatus shown in FIG. 1.
Figure 3:
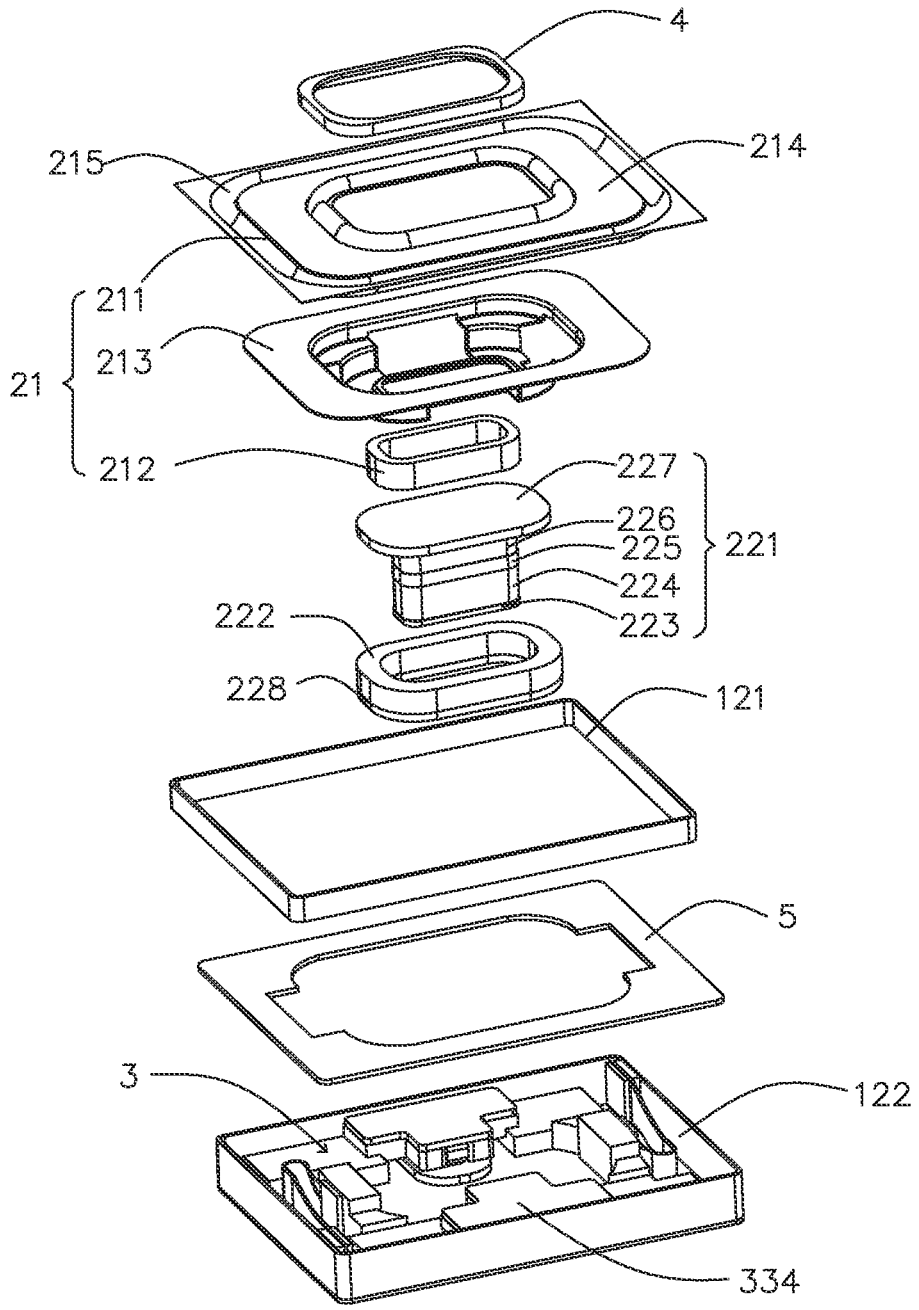
FIG. 3 is another partial exploded view of the multi-functional sound producing apparatus shown in FIG. 1.
Figure 4:
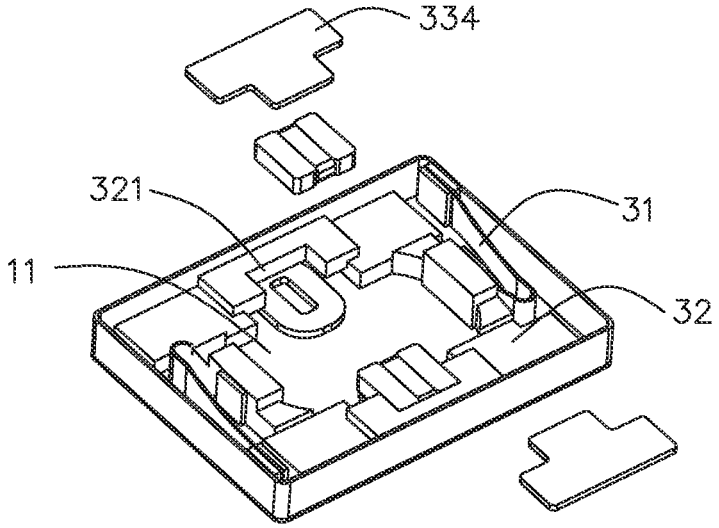
FIG. 4 is a partial exploded view of some members in the multi-functional sound producing apparatus shown in FIG. 1.
Figure 5:
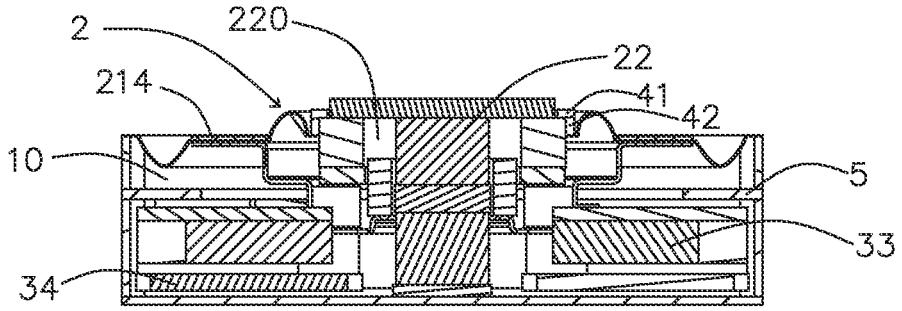
FIG. 5 is a sectional view taken along a line A-A in FIG. 1.

The technical solutions in the embodiments of the present disclosure will be described clearly and completely below with reference to the accompanying drawings in the embodiments of the present disclosure. Apparently, the described embodiments are merely some of rather than all of the embodiments of the present disclosure. All other embodiments acquired by those of ordinary skill in the art without creative efforts based on the embodiments of the present disclosure shall fall within the protection scope of the present disclosure.

Referring to FIG. 1 to FIG. 6 together, a multi-functional sound producing apparatus 100 according to a first embodiment of the present disclosure may be applied to electronic equipment. The multi-functional sound producing apparatus 100 may produce sound and act as a motor by vibration. The multi-functional sound producing apparatus 100 includes a housing 1 having a receiving cavity 10, a sound producing device 2 arranged in the receiving cavity 10, a motor device 3, and a fixed ring 4 fixed to the sound producing device 2. The multi-functional sound producing apparatus 100 is of a rectangle structure.

The fixed ring 4 includes a first part 41 extending horizontally and a second part 42 bending and extending from the first part. The second part 42 extends along a vertical direction.

The housing 1 includes a bottom wall 11 and a side wall 12 bending and extending from the bottom wall 11. The side wall 12 of the housing 1 includes a first side wall 121 and a second side wall 122 stacked on each other. The multi-functional sound producing apparatus 100 further includes an air-permeable isolation member 5 sandwiched between the first side wall 121 and the second side wall 122. The air-permeable isolation member 5 extends into the receiving cavity 10. The air-permeable isolation member 5 is of a hollow ring-shaped structure, which can limit and protect the multi-functional sound producing apparatus 100 in case of falling off.

The sound producing device 2 includes a vibration system 21 and a magnetic circuit unit 22 driving the vibration system 21 to vibrate to produce sound along a first direction. The first direction is Direction Z shown in FIG. 2.

The vibration system 21 includes a diaphragm 211, a voice coil 212 driving the diaphragm 211 to vibrate to produce sound, and a voice coil bracket 213 connecting the voice coil 212 and the diaphragm 211. The diaphragm 211 includes a dome 214 and a suspension 215 fixed to the side of the dome 214 close to the motor device 3, the side of the suspension 215 close to the magnetic circuit unit 22 is connected to the side wall 12 of the housing 1, specifically fixedly connected to the first side wall 121. The side of the suspension 215 close to the magnetic circuit unit 22 is connected to a lower surface of the second part 42 of the fixed ring 4.

The voice coil bracket 213 includes a first fixed portion 216 connected to the voice coil 212, a second fixed portion 217 connected to the diaphragm 211, and a connecting portion 218 that connects the first fixed portion 216 and the second fixed portion 217 and has step structure. The first fixed portion 216 and the second fixed portion 217 are both of a ring-shaped structure. The first fixed portion 216 is fixedly connected to a lower surface of the voice coil 212. The second fixed portion 217 is fixedly connected to a lower surface of the suspension 215. A plurality of connecting portions 218 are provided and spaced from one another. In this way, adjacent connecting portions 218 may provide sufficient avoiding space for other members. The structure of the voice coil bracket 213 according to the present disclosure can ensure high-frequency frequency response characteristics of the sound producing device 2.

The magnetic circuit unit 22 includes a main magnet assembly 221 fixed to the bottom wall 11 and an auxiliary magnet 222 spaced from the main magnet assembly 221 to form a magnetic gap 220. The main magnet assembly 221 includes, from bottom to top, a first pole plate 223, a first main magnet 224, a second pole plate 225, a second main magnet 226, and a third pole plate 227 that are stacked. The first pole plate 223 is fixed to the bottom wall 11 of the housing 1. The auxiliary magnet 222 is of a ring-shaped structure and arranged around the main magnet assembly 221. The third pole pate 227 simultaneously covers the second main magnet 226 and at least part of the auxiliary magnet 222. The magnetic circuit unit 22 further includes an auxiliary pole plate 228 arranged on the side of the auxiliary magnet 222 away from the diaphragm 211. The auxiliary pole plate 228 is also of a ring-shaped structure.

The motor device 3 includes an elastic member 31 fixedly connected to the housing 1, a weight 32 connected to the elastic member 31 to be suspended in the receiving cavity 10, a magnet component 33 fixed to the weight 32 and vibrating along a second direction together with the weight 32, and a driving member 34 fixed to the bottom wall 11 of the housing 1 to drive the magnet component 33 to vibrate. The second direction is perpendicular to the first direction, and is Direction X shown in FIG. 2. The weight 32 is of a hollow ring-shaped structure, and the weight 32 is provided with a recess 321 for receiving the magnet component 33.

Figure 6:
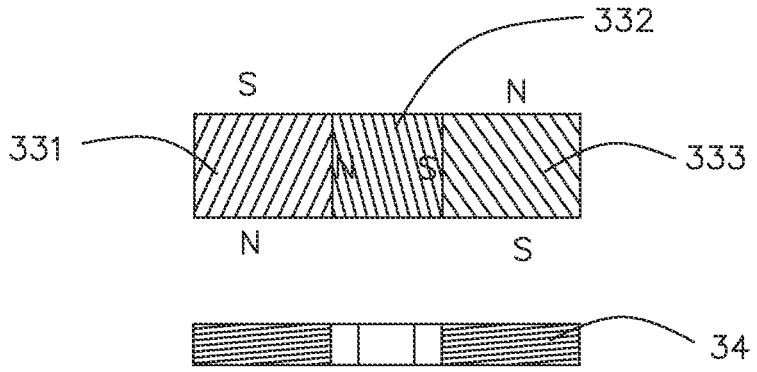
FIG. 6 is a sectional view of a coil and a magnet in the multi-functional sound producing apparatus shown in FIG. 1.

In the first embodiment of the present disclosure, the driving member 34 is a coil, the magnet component 33 includes a first magnet 331, a second magnet 332, and a third magnet 333 arranged side by side, the first magnet 331 the third magnet 333 are magnetized along the first direction Z and have opposite polarity, and the second magnet 332 is magnetized along the second direction X. The magnet component 33 further includes a clamp plate 334 covering the first magnet 331, the second magnet 332, and the third magnet 333 along the first direction Z. The clamp plate 334 covers the first magnet 331, the second magnet 332, and the third magnet 333 and also covers part of the weight 32. Referring to FIG. 6, an example of magnetization directions of the first magnet 331, the second magnet 332, and the third magnet 333 is illustrated. At least two opposite sides of the main magnet assembly 221 are each provided with one group of the magnet component 33 and the driving member 34. Certainly, four sides of the multi-functional sound producing apparatus 100 may be each provided with one group of the magnet component 33 and the driving member 34. Optionally, the magnet component 33 and the driving member 34 are arranged in a major-axis direction of the multi-functional sound producing apparatus 100.

Figure 7:
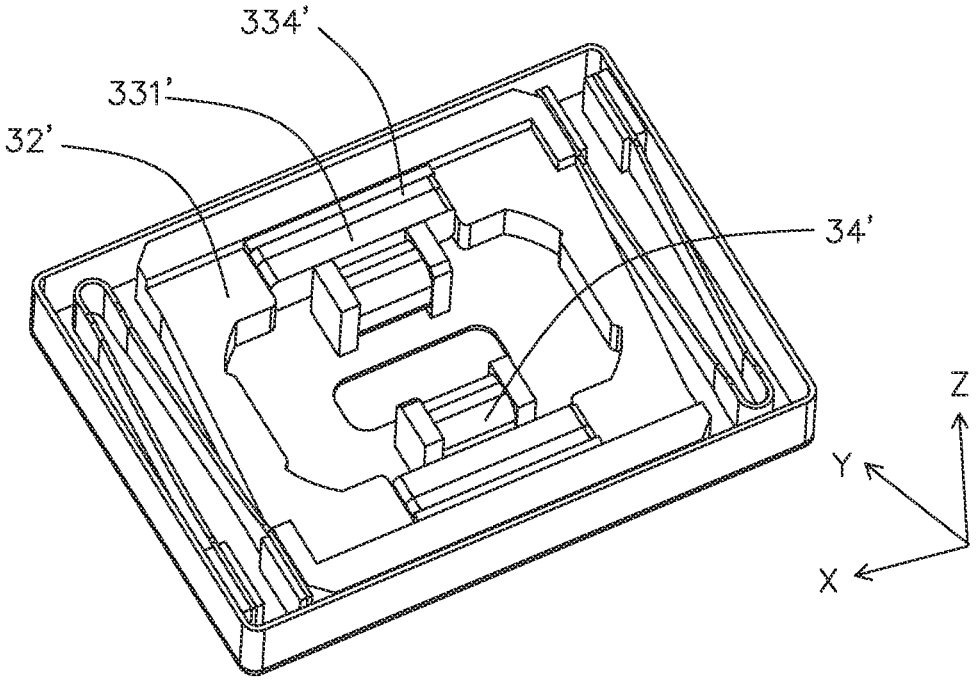
FIG. 7 is a three-dimensional view of some members in a multi-functional sound producing apparatus according to a second embodiment of the present disclosure.
Figure 8:
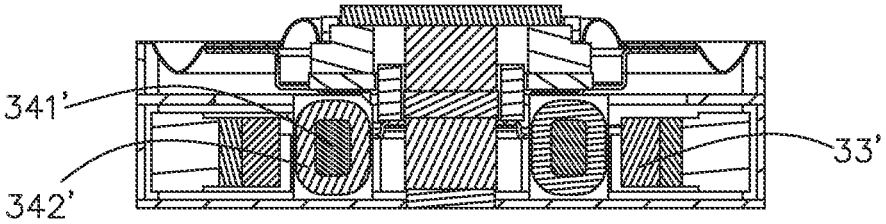
FIG. 8 is a sectional view of the multi-functional sound producing apparatus according to the second embodiment of the present disclosure.
Figure 9:
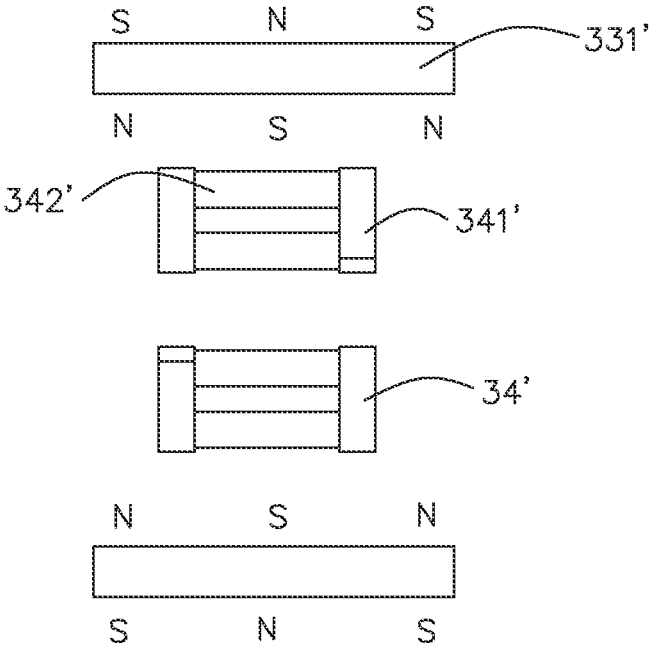
FIG. 9 is a top view of a solenoid and a magnet in the multi-functional sound producing apparatus shown in FIG. 7.

In a second embodiment of the present disclosure, as shown in FIG. 7 to FIG. 9, the driving member 34' includes an iron core 341' and a solenoid 342' wound on the iron core 341', the magnet component 33' includes a magnet 331', the magnet 331' is magnetized along a third direction, and the third direction Y is perpendicular to the first direction Z and perpendicular to the second direction X The magnet 331' is a three-stage magnetized magnet, and the polarity in the middle of the magnet 331' is opposite to the polarity at each of two ends of the magnet. Referring to FIG. 9, an example of a magnetization direction of the magnet 331' is illustrated. The magnet component 33' includes a clamp plate 334' attached to one side of the magnet 331' along the third direction Y. The clamp plate 334' is sandwiched between the weight 32' and the magnet 331'.

Compared with the related art, a multi-functional sound producing apparatus according to the present disclosure includes a housing defining a receiving cavity and a sound producing device arranged in the receiving cavity. The housing includes a bottom wall and a side wall bending and extending from the bottom wall. The sound producing device includes a vibration system and a magnetic circuit unit driving the vibration system to vibrate to produce sound along a first direction, the magnetic circuit unit including a main magnet assembly fixed to the bottom wall and an auxiliary magnet spaced from the main magnet assembly to form a magnetic gap. The multi-functional sound producing apparatus further includes a motor device arranged in the receiving cavity. The motor device includes an elastic member fixedly connected to the housing, a weight connected to the elastic member to be suspended in the receiving cavity, a magnet component fixed to the weight and vibrating along a second direction together with the weight, and a driving member fixed to the bottom wall to drive the magnet component to vibrate. Two groups of the magnet component and the driving member are provided, two opposite sides of the main magnet assembly are each provided with one group of the magnet component and the driving member, and the second direction is perpendicular to the first direction. According to the present disclosure, the same apparatus can realize the performance of a speaker and a motor at the same time, and the assembly of the device is simple through reasonable position design. The motor device makes full use of left and right spaces of the magnetic circuit in the sound producing device without additionally increasing the volume of the device, thereby saving more overall space and having lower costs.

The above are only embodiments of the present disclosure. It should be pointed out herein that, for those of ordinary skill in the art, improvements can also be made without departing from the creative concept of the present disclosure, all of which fall within the protection scope of the present disclosure.

What is claimed is:

1. A multi-functional sound producing apparatus, comprising a housing defining a receiving cavity and a sound producing device arranged in the receiving cavity, wherein the housing comprises a bottom wall and a side wall bending and extending from the bottom wall, and the sound producing device comprises a vibration system and a magnetic circuit unit that drives the vibration system to vibrate along a first direction to produce sound, wherein the magnetic circuit unit comprises a main magnet assembly fixed to the bottom wall and an auxiliary magnet spaced from the main magnet assembly to form a magnetic gap, and wherein the multi-functional sound producing apparatus further comprises a motor device arranged in the receiving cavity, the motor device comprises an elastic member fixedly connected to the housing, a weight connected to the elastic member to be suspended in the receiving cavity, a magnet assembly fixed to the weight and vibrating along a second direction together with the weight, and a driving member fixed to the bottom wall to drive the magnet assembly to vibrate, and wherein two groups of the magnet assembly and the driving member are provided, each of two opposite sides of the main magnet assembly is provided with one group of the two groups of the magnet assembly and the driving member, and the second direction is perpendicular to the first direction.

2. The multi-functional sound producing apparatus as described in claim 1, wherein the driving member is a coil, the magnet assembly comprises a first magnet, a second magnet, and a third magnet arranged side by side, and the first magnet and the third magnet are magnetized along the first direction and have opposite polarity, and the second magnet is magnetized along the second direction.

3. The multi-functional sound producing apparatus as described in claim 1, wherein the driving member comprises an iron core and a solenoid wound on the iron core, the magnet assembly comprises a magnet, the magnet is magnetized along a third direction, and the third direction is perpendicular to the first direction and perpendicular to the second direction.

4. The multi-functional sound producing apparatus as described in claim 3, wherein the magnet is a three-stage magnetized magnet, and a polarity at a middle of the magnet is opposite to a polarity at each of two ends of the magnet.

5. The multi-functional sound producing apparatus as described in claim 1, wherein the weight is of a hollow ring-shaped structure, and the weight is provided with a recess for receiving the magnet assembly.

6. The multi-functional sound producing apparatus as described in claim 1, wherein the multi-functional sound producing apparatus has a rectangle structure, and the magnet assembly and the driving member are arranged in a major-axis direction of the multi-functional sound producing apparatus.

7. The multi-functional sound producing apparatus as described in claim 1, wherein the vibration system comprises a diaphragm, a voice coil for driving the diaphragm to vibrate to produce sound, and a voice coil bracket for connecting the voice coil and the diaphragm, wherein the voice coil bracket comprises a first fixed portion connected to the voice coil, a second fixed portion connected to the diaphragm, and a connecting portion that connects the first fixed portion and the second fixed portion and has a step structure, and a plurality of connecting portions are provided and spaced from one another.

8. The multi-functional sound producing apparatus as described in claim 7, further comprising a fixed ring, and the fixed ring has one end fixedly connected to the magnetic circuit unit and another end fixedly connected to the diaphragm.

9. The multi-functional sound producing apparatus as described in claim 8, wherein the diaphragm comprises a dome and a suspension fixed to a side of the dome close to the motor device, a side of the suspension close to the magnetic circuit unit is connected to the fixed ring, and a side of the suspension away from the magnetic circuit unit is connected to the side wall of the housing.

10. The multi-functional sound producing apparatus as described in claim 9, wherein the side wall of the housing comprises a first side wall and a second side wall arranged to stack on each other, the multi-functional sound producing apparatus further comprises an air-permeable isolation member sandwiched between the first side wall and the second side wall, and the air-permeable isolation member extends into the receiving cavity.

* * * * *